US006647975B2

(12) United States Patent
Whitfield

(10) Patent No.: US 6,647,975 B2
(45) Date of Patent: Nov. 18, 2003

(54) CONVERTIBLE BALL PROJECTING APPARATUS HAVING A REPLACEABLE FORK ASSEMBLY

(76) Inventor: Terry Whitfield, 849 Clearfield Dr., Millbrae, CA (US) 94030

( * ) Notice: Subject to any disclaimer, the term of this patent is extended or adjusted under 35 U.S.C. 154(b) by 37 days.

(21) Appl. No.: 10/006,493

(22) Filed: Dec. 5, 2001

(65) Prior Publication Data

US 2003/0101976 A1 Jun. 5, 2003

(51) Int. Cl.[7] ..... F41B 7/00
(52) U.S. Cl. ..... 124/16
(58) Field of Search ..... 124/16, 26, 51.1, 124/50, 53, 82

(56) References Cited

U.S. PATENT DOCUMENTS 4,262,648 A 4/1981 Wegener et al. ..... 124/6
4,669,444 A 6/1987 Whitfield et al. ..... 124/16
4,676,504 A 6/1987 Ponza ..... 273/26 D
5,066,010 A 11/1991 Pingston ..... 273/26 D
5,415,150 A * 5/1995 Dallas ..... 124/50

* cited by examiner

*Primary Examiner*—Kien T. Nguyen
(74) *Attorney, Agent, or Firm*—Law Offices of Terry McHugh

(57) ABSTRACT

The invention relates to a ball projecting apparatus having a ball singulator with a fork-and-actuator mechanism that is adjustable to allow the apparatus to be used for a variety of different sports. A fork assembly is adjustable or replaceable to convert the apparatus from use with balls of one sport to use with balls of a different sport. Each fork may be referred to as a "rocker," since it is pivoted from a first position in which a foremost ball is impeded from advancing to a second position in which the foremost ball is released, but the next ball is impeded. The rocking motion alternates which of two prongs is within the ball-supply path. When the forward prong is in the ball-supply path, all balls are prevented from advancing. Alternatively, when the rearward prong is in the ball-supply path, the foremost ball is allowed to advance.

16 Claims, 7 Drawing Sheets

CONVERTIBLE BALL PROJECTING APPARATUS HAVING A REPLACEABLE FORK ASSEMBLY

TECHNICAL FIELD

The invention relates generally to devices that are used to project a sequence of balls at a controlled rate and more particularly to such devices that are easily converted from use with one given-sized ball to a significantly different-sized ball.

DESCRIPTION OF THE RELATED ART

There are a number of available devices which are used to improve the playing skills of participants of a particular sport. Ball tossing devices are commonly used in such sports as tennis, baseball and softball to develop hitting and catching skills. Ball tossing devices may also be useful for sports in which the ball is significantly larger (e.g., soccer) and/or has a shape other than a sphere (e.g., American football).

U.S. Pat. No. 4,669,444 to Whitfield et al. describes a ball tossing apparatus which varies the direction of successive tosses. The apparatus includes a cam mechanism which extends to the exterior of a housing. Rotation of a cam shaft changes the tilt angle of the housing and the direction of the next toss. The apparatus may be used in a hitting practice or a fielding practice in such sports as baseball and softball, but different sports require different embodiments of the apparatus.

A ball pitching device is described in U.S. Pat. No. 5,562,282 to Stevenson. The device is particularly adapted for use in softball, since it simulates the mechanics of an underhand fast pitch. A pitching arm is pivoted to a ball-engaging position, where it receives a ball from a supply chamber. The pitching arm is caused to pivot forwardly to project the ball. The pitching arm then returns to its ball-engaging position to receive a next ball.

While the known devices operate well for their intended purposes, the devices are not easily adapted for use in different sports. Thus, a supplier may need to provide a different device for sports in which balls have different sizes. Even within the same sport, the regulation ball may vary. For example, most governing bodies of organized softball dictate a 12-inch (30.48 cm) regulation softball, but allow an 11-inch (27.94 cm) softball for younger players, such as those in ten-and-under age leagues. For some ball tossing devices, this difference in ball size makes the difference between whether a particular machine may be used or is unsuitable.

Not all devices are restricted to use with a single ball. U.S. Pat. No. 5,066,010 to Pingston describes a ball dispensing machine that may be used for different-sized balls. The machine includes a carrier from which a ball is dropped, so that a player can attempt to hit the ball before it reaches the ground. The carrier has a relatively large U-shape, but guide bars may be inserted into the carrier to reduce the dimensions. As a result of the insertable guide bars, the machine is adaptable to be used in sports having different-sized balls. However, there are sports skills that are best practiced by utilizing a means for projecting the ball, rather than dropping it. Thus, the Pingston machine is versatile with respect to the selection of the ball, but its versatility is somewhat limited with respect to the range of skills that can be developed.

What is needed is a ball projecting apparatus which may be used to practice skills in a variety of different sports.

SUMMARY OF THE INVENTION

A ball projecting apparatus in accordance with the invention includes a singulator that has a fork-and-actuator mechanism that is adjustable to allow the apparatus to be used for a variety of sports. The positions of fork prongs relative to each other and to a ball-supply path determine the dimensions of the balls for which the singulator is currently suited. In the preferred embodiment, the apparatus includes a set of forks, so that the fork can be changed in order to convert the singulator from use in one sport to use in another. However, the adjustment may be made on a single fork, if the fork is designed to enable adjustments.

The fork of the singulator may also be referred to as a rocker, since it is pivoted between either a first position in which a foremost ball along the ball-supply path is impeded from advancing or a second position in which the foremost ball is released, but the next ball is impeded. Typically, the ball-supply path is a gravity-feed ball path. When the fork is in the first position, a forward prong of the fork contacts the downstream surface of the foremost ball. However, by rocking the fork to the second position, the forward prong rises above the level of the foremost ball, while the rearward prong is lowered to prevent the next ball from advancing with the foremost ball.

The fork prongs extend in a direction that is generally perpendicular to the ball path. In the preferred embodiment, each fork includes a metallic plate from which the fork prongs are cantilevered. In this embodiment, the fork that is presently mounted within the apparatus can be easily removed and replaced with another fork that is designed for a different-sized ball. However, other embodiments are contemplated. For example, each fork may have a pair of plates that are connected at opposite ends of the fork prongs.

In addition to changing the distance between the two fork prongs, a conversion from one sport to another sport may require an adjustment of the space between each prong and the ramp that forms the ball-supply path. This adjustment may be accomplished by varying the length of an actuator arm which controls the rocking of the fork.

The apparatus also includes a projection mechanism for releasing the ball that is within a firing chamber of the apparatus. Preferably, the projection mechanism is also sport-neutral (i.e., does not restrict the apparatus to use for balls of a particular sport). A ball may be projected by first relaxing a belt and then tensioning the belt to propel a ball that is resting on the belt. Since the relaxed belt will conform to the shape of the ball, the dimensions of the ball are not critical to proper operation. Thus, the invention is easily adapted for use in sports that include volleyball, basketball, lacrosse, etc. In fact, if the ball feeding mechanism is properly constructed, the invention may be used in sports having non-spherical balls (e.g., American football) or in hockey if the hockey pucks are fed into the apparatus so that they roll along their circumferential edges as they progress along the supply path.

DETAILED DESCRIPTION

Figure 1:
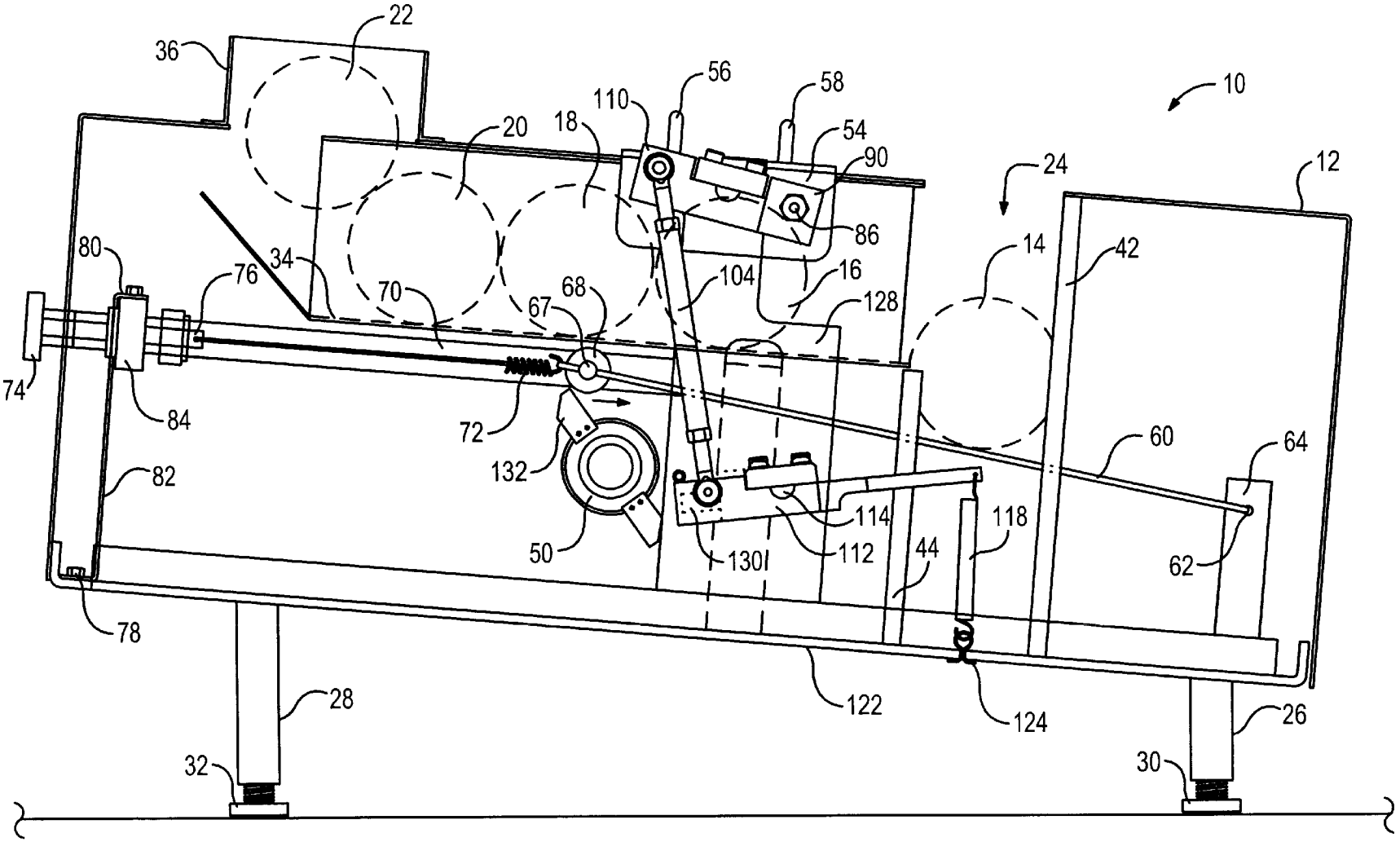
FIG. 1 is a side view of a ball projecting apparatus having an adjustable fork-and-actuator mechanism in accordance with one embodiment of the invention.

With reference to FIG. 1, a sport-convertible apparatus 10 is shown as including a housing 12 in which balls 14, 16, 18, 20 and 22 are gravity-fed along a ball-supply path to a firing chamber 24. As will be described in detail below, the apparatus includes a singulator that can be adjusted from one that handles a given-sized ball to one that handles a different-sized ball. Many of the features that are unrelated to the adjustable singulator are described in U.S. Pat. No. 4,669,444 to Whitfield et al., which is hereby incorporated by reference.

The apparatus 10 includes a pair of adjustable legs 26 and 28 from which an internally threaded lower portion telescopes by manually rotating the attached feet 30 and 32. The rearward leg 28 is longer, so that the balls 16–22 along the supply path formed by a ramp 34 abut each other while being pulled by gravity toward the singulator position of the foremost ball 16 and then from the singulator position to the firing chamber 24, as indicated by ball 14. The use of the legs 26 and 28 is not critical to the invention, since other means for achieving the desired slant of the apparatus 10 may be substituted.

Figure 2:
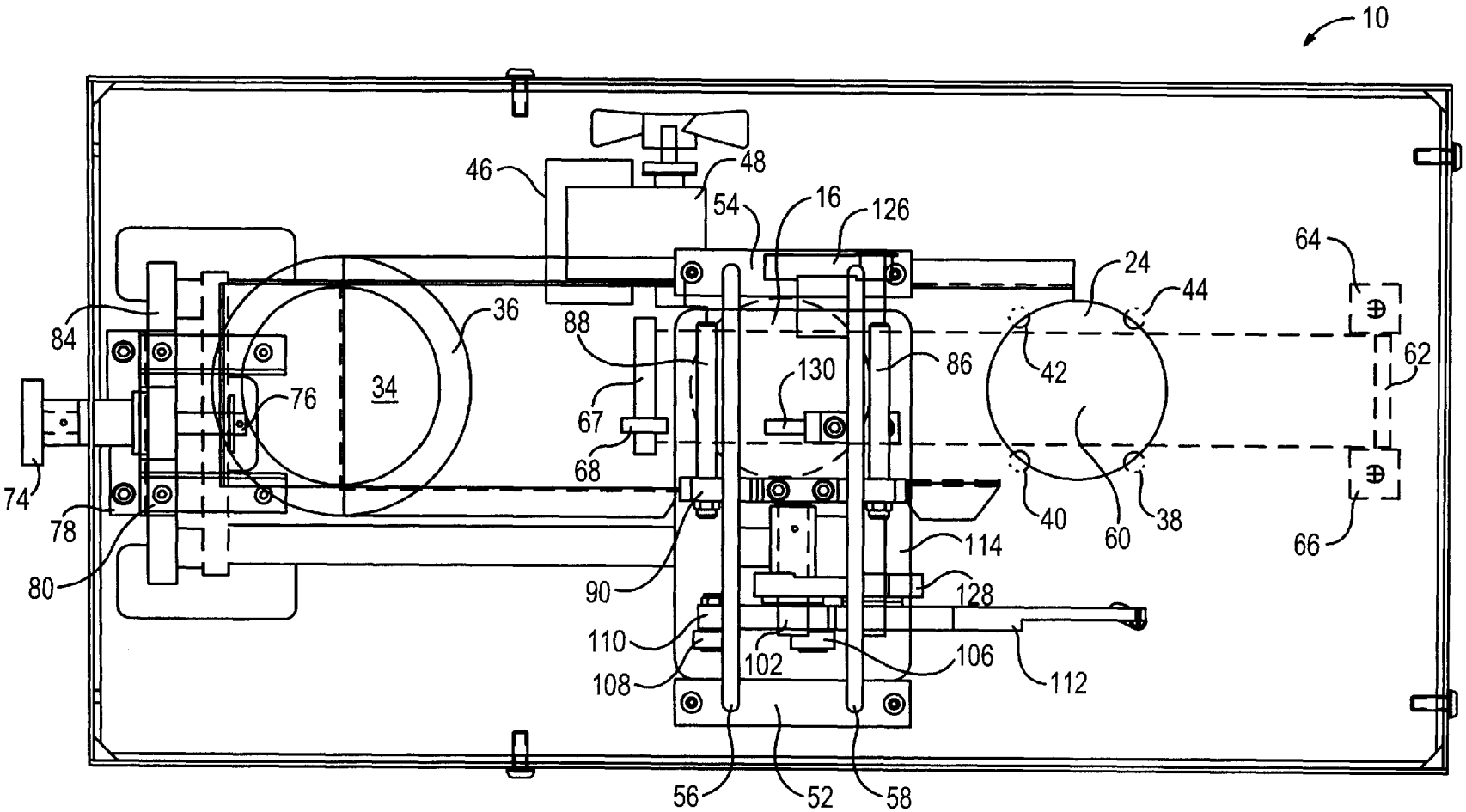
FIG. 2 is a top view of the apparatus of FIG. 1, with selected components being shown for greater clarity.

Referring now to FIGS. 1 and 2, the apparatus includes a cylindrical sleeve 36 that provides the opening through which the balls 14–22 are introduced. A hopper (not shown) or similar device may be connected to the sleeve to provide a continuous supply of balls to the apparatus. There is also an opening through the housing 12 to the firing chamber 24, so that the ball 14 may be projected through the opening. Four cylindrical ball guides 38, 40, 42 and 44 seat the ball 14 within the firing chamber and guide the ball when fired.

A single motor assembly 46 is used to drive all of the functions of the apparatus 10. A fan 48 is used to provide cooling. Preferably, the motor assembly includes an electric motor, but other types of motors may be substituted. While not shown in FIGS. 1 and 2, the motor assembly drives rotation of a continuous chain, such as the bicycle-type chain described in the above-referenced patent to Whitfield et al. The chain includes one or more actuating members 50 that determine the timing of the repeating operations, as will be explained more fully below.

A number of non-critical features are illustrated in FIGS. 1 and 2. For example, the shield for protecting the moving parts is included in the drawings. The shield has a pair of end plates 52 and 54 and has upwardly projecting elongated members 56 and 58. A beneficial, but optional, feature provides adjustable tensioning of a projection belt 60. It is the projection belt that is manipulated to fire the ball 14 from the firing chamber 24. The tension on the belt determines the force that will be applied to the ball. One end of the belt 60 is secured to a rod 62 that extends between a pair of posts 64 and 66. For example, a loop may be formed at the end of the belt and the rod may pass through the loop. The opposite end of the belt is similarly connected to a rod 67, which passes through a spring-loaded member 68 that is allowed to travel within a slot 70. As shown in FIG. 1, a coil spring 72 biases the spring-loaded member 68 rearwardly, so that the projection belt 60 is pulled into a taut condition. The tension provided by the coil spring is adjustable by rotating an external knob 74 at the rearward end of the apparatus 10. Counterclockwise rotation of the knob 74 may increase the tension on the belt 60, while clockwise rotation decreases the tension.

Some of the mechanical features for implementing the belt-tensioning adjustment are shown in FIGS. 1 and 2, but other arrangements may be substituted. An end of the coil spring 72 is connected to a rotatable shaft 76 that is manipulated by the external knob 74. A brace has upper and lower horizontal portions 78 and 80 at opposite ends of a vertical portion 82. The upper horizontal portion 80 is secured to a tube end plate 84 through which the tension shaft 76 passes.

A critical feature of the apparatus 10 is the adjustability of a fork-and-actuator mechanism. Referring to the top view of FIG. 2, this mechanism includes a forward prong 86 and a rearward prong 88. The prongs are cantilevered from a fork plate 90. While the cantilevered arrangement provides an advantage with regard to replacing the fork assembly in order to accommodate a different-sized ball, there may be embodiments in which it is preferable to have fork plates at both ends of the prongs 86 and 88. The spacing between the two prongs plays an important role in determining the size of the ball for which the apparatus is best suited. Moreover, the positions of the prongs relative to the ramp 34 that defines the ball-supply path plays an important role in reliably separating the foremost ball for advancement into the firing chamber 24. The spacing between the two prongs should be generally equal to the diameter of the balls. The distance between the prongs and the ramp should be such that when the fork plate 90 is rocked about a pivot axis, the prongs individually alternate between being spaced from the ramp by a distance less than the diameter of the balls and being spaced from the ramp by a distance greater than the diameter of the balls.

Figure 5:
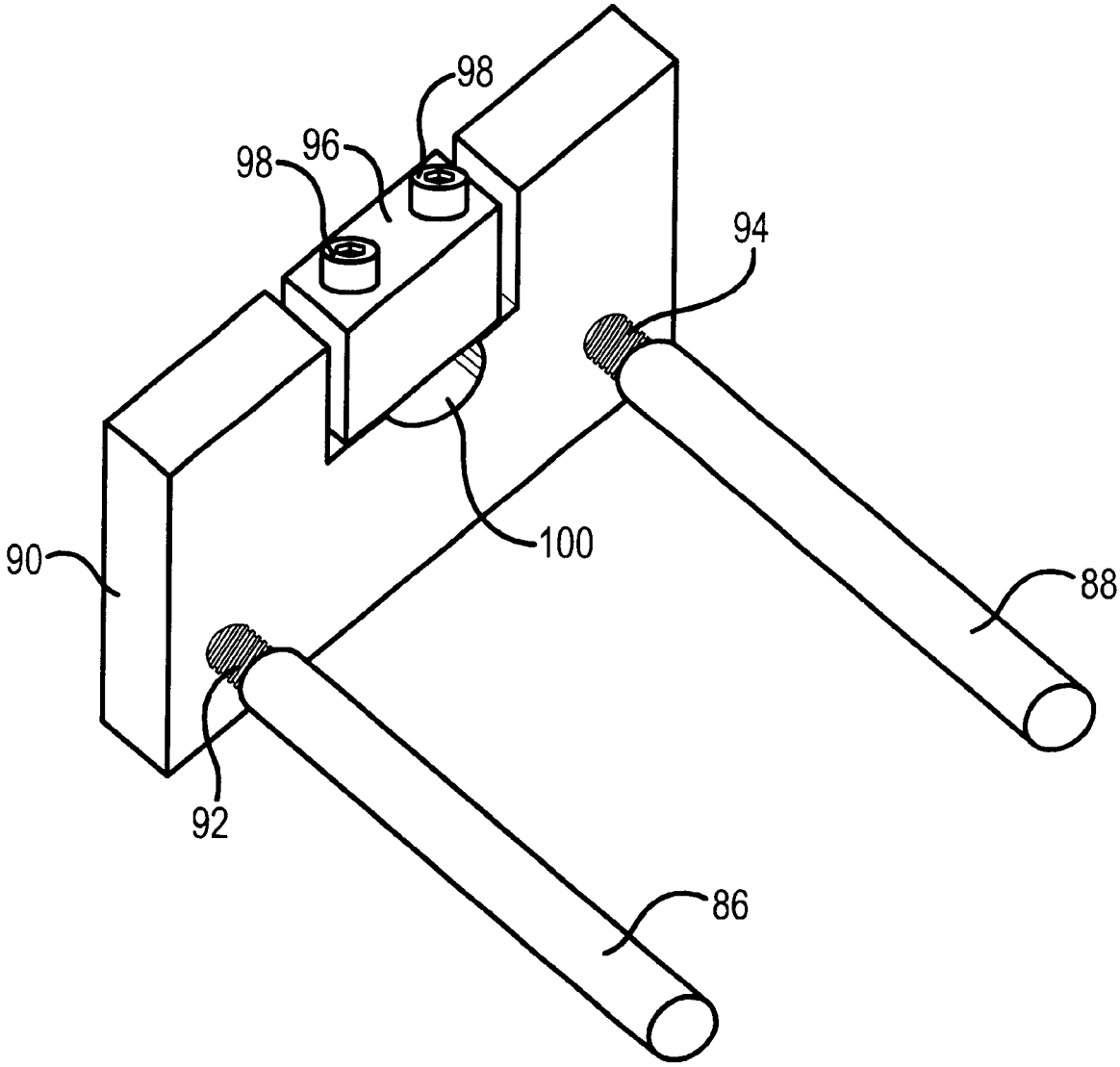
FIG. 5 is a perspective view of the fork of the mechanism of FIG. 4.
Figure 6:
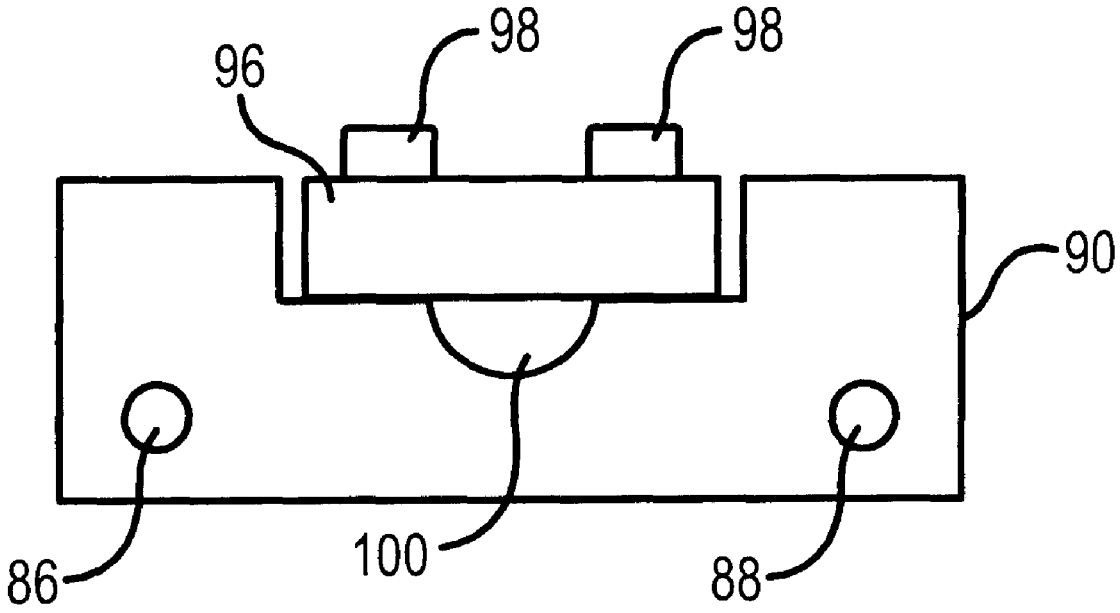
FIG. 6 is a rear view of the fork of FIG. 5.

The manipulation of the fork prongs 86 and 88 will be described in greater detail with reference to FIGS. 3 and 4. However, the structure of the fork itself can be best seen in FIGS. 5 and 6. The fork plate 90 includes internally threaded bores into which the threaded ends 92 and 94 of the prongs 86 and 88 are attached. The prongs should be sufficiently long to ensure that a ball cannot pass to the outside of the prongs while progressing along the ball-supply path of the apparatus.

A lever clamp 96 fits within a cutaway region of the fork plate 90 and is held in position by a pair of fasteners 98. The lever clamp secures a fork shaft (not shown) in position when the fork assembly is mounted for rocking motion within the apparatus. With the lever clamp in place, an opening 100 has a shape that corresponds to the end of the fork shaft.

Figure 3:
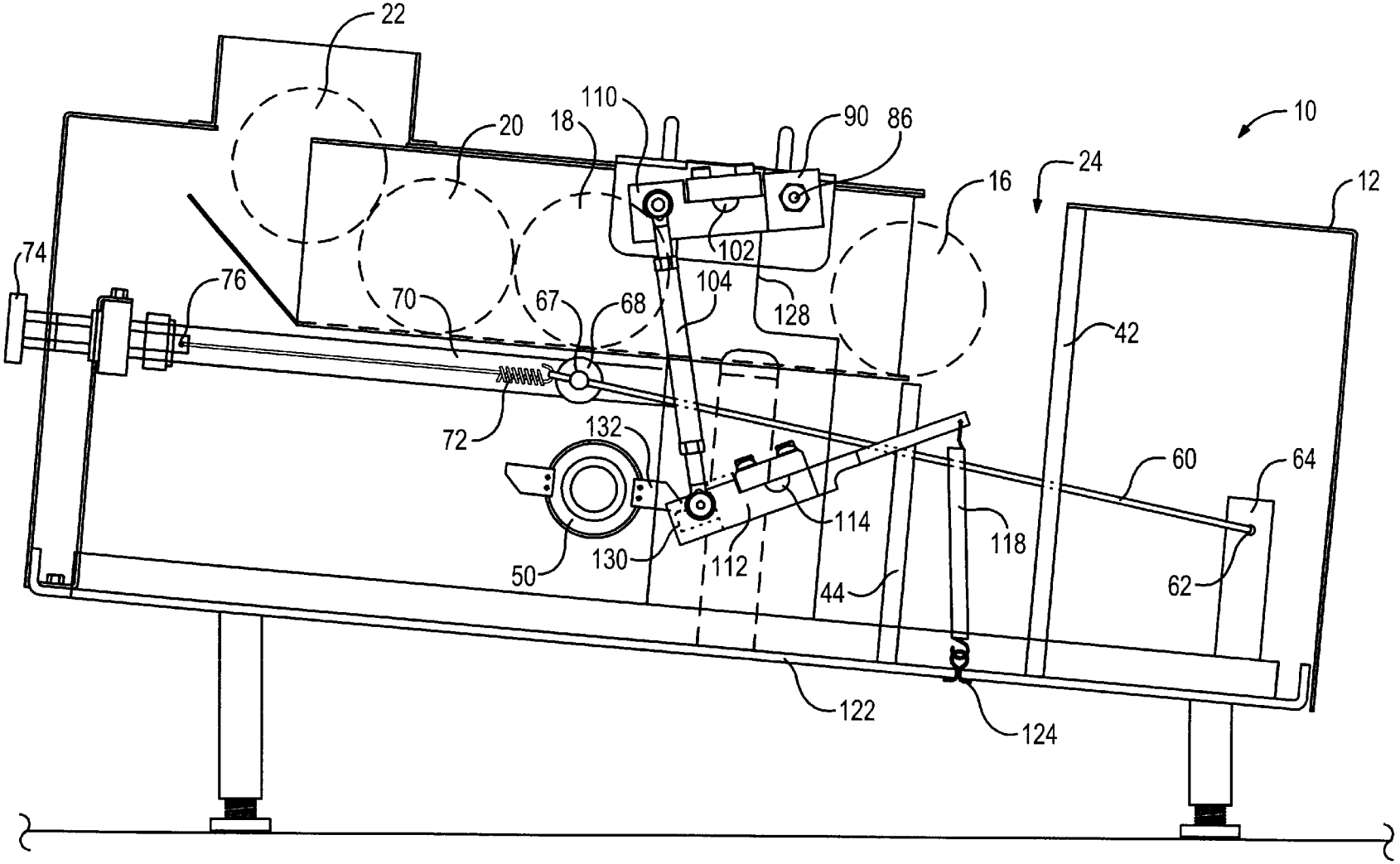
FIG. 3 is a side view of the apparatus of FIG. 1, but with the adjustable fork-and-actuator mechanism in a ball-release position.
Figure 4:
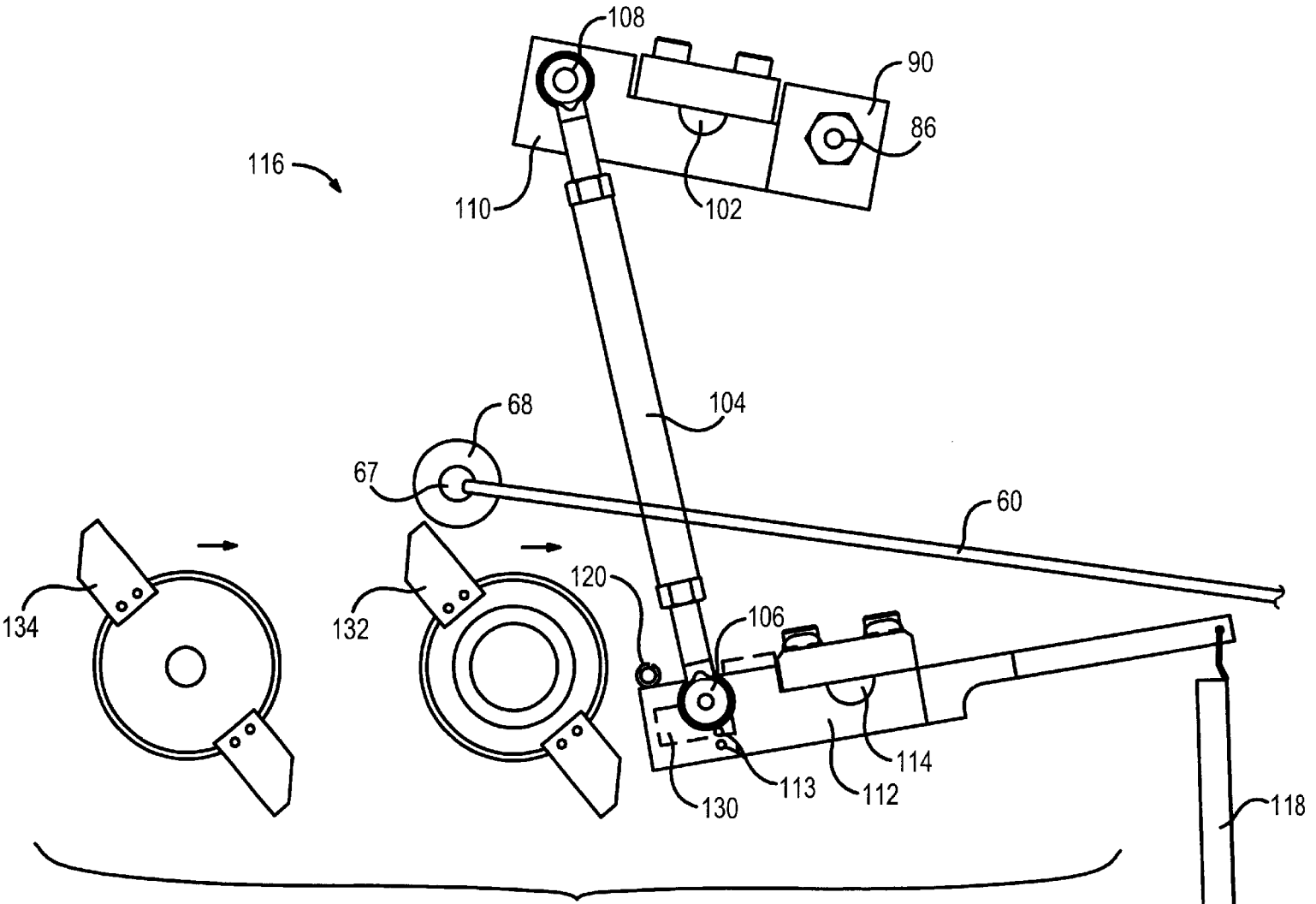
FIG. 4 is a side view of the fork-and-actuator mechanism of FIG. 1.

FIGS. 1 and 4 show the fork in a first position, while FIG. 3 shows the fork in a second position. As best seen in FIG. 1, the first position is one in which the forward portion of the fork plate 90 is lowered, so that the forward prong 86 blocks the path of the foremost ball 16. Thus, the foremost ball is impeded from further travel along the ball-supply path to the firing chamber 24. On the other hand, in the second position shown in FIG. 3, the forward prong 86 is raised above the level of the foremost ball, allowing the ball 16 to roll toward the firing chamber 24. In the figure, the ball 16 is shown in a position just prior to dropping into the firing chamber. While the forward portion of the fork 90 is raised, the rearward portion of the fork is lowered, so that the rearward prong blocks the path of the next ball 18.

In a simplified explanation of the singulation operation, the timing of the release of balls to the firing chamber 24 is determined merely by rocking the fork plate 90. When the fork plate is angled downwardly from its rearward portion to its forward portion, all of the balls waiting to enter the firing chamber 24 are impeded from progress past the forward prong 86. On the other hand, when the fork plate is rocked in a counterclockwise direction eighteen to twenty degrees, the forward prong is rotated out of its blocking position, but the rearward prong 88 moves into a blocking position with respect to the next ball 18. Once the foremost ball has moved past the area of the fork, the fork plate 90 may be again rocked in a clockwise direction to allow the next ball 18 to roll into the foremost position against the forward prong 86.

In the embodiment of FIGS. 1–4, one possible assembly for providing the fork rocking is illustrated. Referring primarily to FIG. 4, a connecting rod 104 has opposite ends that are attached by hind joints 106 and 108 to a lower lever 112 and an upper lever 110. The tensioning of the connecting rod is adjusted by securing the lower hind joint 106 to any one of a series of holes 113. Alternatively, the series of holes may be formed within the upper lever 110. While the side view may cause it to appear otherwise, only a portion of the fork plate 90 is shown in the side views of FIGS. 1, 3 and 4, since the upper lever 110 visually blocks all but the forward portion of the fork plate 90. Referring briefly to FIG. 2, the upper lever 110 is coupled to the fork plate 90 by the fork shaft 102 that was described above. The fork shaft is rotatable, so that rotation of the upper lever 110 causes rotation of the fork plate 90, and therefore angular displacement of the forward and rearward prongs 86 and 88.

Returning to FIG. 4, the lower lever 112 rotates about a pivot point that is defined by a pawl shaft 114. FIG. 4 shows the adjustable fork-and-actuator mechanism 116 in its rest position. This rest position is dictated by a spring member 118 and a stop 120 at opposite sides of the lower lever 112. The spring member pulls an arm of the lower lever 112 to bias the lever for clockwise rotation. However, the stop 120 limits the extent to which the lever can rotate. Referring briefly to the side views of FIGS. 1 and 3, the spring member 118 is secured to the base 122 of the housing 12 by a cotter pin 124. The stop 120 is fixed in position and is preferably an elastomeric member.

Again referring briefly to the top view of FIG. 2, the pawl shaft 114 is rotatably held in position at one end by a pawl bearing plate 126 and at the opposite end by a bearing plate 128 that supports the fork shaft 102 in addition to the pawl shaft 114. A pawl 130 is clamped to the pawl shaft. Thus, force applied to the pawl will cause the fork-and-actuator mechanism 116 of FIG. 4 to be moved out of the rest position illustrated in FIG. 4. The source of this applied force is a dog 132 that is connected to the motor-driven continuous chain described above. In the rest positions of FIGS. 1 and 4, the dog 132 is out of contact with the pawl 130. However, in FIG. 3, the rotation of the continuous chain has caused the dog 132 to contact the pawl 130. The continued motion of the dog 132 displaces the pawl to rotate about the shaft 114 on which it is mounted. The rotation of the shaft is transferred to the lower lever 112, overcoming the bias of the spring member 118. As a result of the counterclockwise rotation of the lower lever, the connector rod 104 pulls the upper lever 110 downwardly. The counterclockwise rotation of the upper lever 110 is translated to the fork plate 90 via the fork shaft 102. Consequently, the forward prong of the fork is moved upwardly to allow the foremost ball 16 to progress to the firing chamber 24. Eventually, the dog 132 releases the contact with the pawl and the fork-and-actuator mechanism 116 returns to the rest position of FIG. 4. The singulation process repeats when a second dog 134 comes into contact with the pawl 130. The timing of the singulation process is a factor of the spacing between dogs and the drive speed of the chain.

The dogs 132 and 134 also determine the timing of the firing sequence for projecting the ball 14 from the firing chamber 24 of FIG. 1. The ball rests on the projection belt 60 that is held in a taut condition by the coil spring 72 that is connected to the spring-loaded bearing member 68. However, as the dog 132 moves forwardly from the position of FIG. 1, it will force the bearing member 68 forwardly within the slot 70. As a consequence, the belt will relax and the ball 14 will be allowed to lower further into the firing chamber 24. Then, as the dog rotates downwardly toward the pawl 130, the spring-loaded bearing member 68 is released. The projection belt 60 is again returned to the taut condition by the bias of the coil spring 72, propelling the ball from the firing chamber 24. As described in the above-cited patent to Whitfield et al., the tension adjustment achieved by means of the external knob 74 varies the flight-determining factors of the projected ball.

Piecing the various operations together, the dog 132 interacts with the spring-loaded bearing member 68 to relax the projection belt 60, but then releases the bearing member to fire the ball 14 as the coil spring 72 pulls the projection belt back to a taut condition. The firing chamber is then again ready to accept a ball. The foremost ball 16 of FIG. 1 is released when the forward fork prong 86 is raised by rocking of the fork plate 90. The elevation of the forward prong 86 is triggered by interaction between the dog 132 and the pawl 130. Simultaneous with the elevation of the forward prong 86, the rearward prong 88 is lowered to impede travel of the next ball 18. This condition is shown in FIG. 3. The dog 132 contacts the pawl 130, which is mounted to the pawl shaft 114. Counterclockwise rotation of the pawl shaft pulls the connector rod 104 downwardly to rotate the upper lever 110 that is mounted at the end of the fork shaft 102 opposite to the fork plate 90. That is, the counterclockwise rotation of the lower lever 112 is accompanied by counterclockwise rotation of both the upper lever 110 and the fork assembly. When the dog releases the pawl, the spring member 118 returns the levers and the fork assembly to the rest position of FIGS. 1 and 4, so that only one ball is allowed to progress to the firing chamber.

Figure 7:
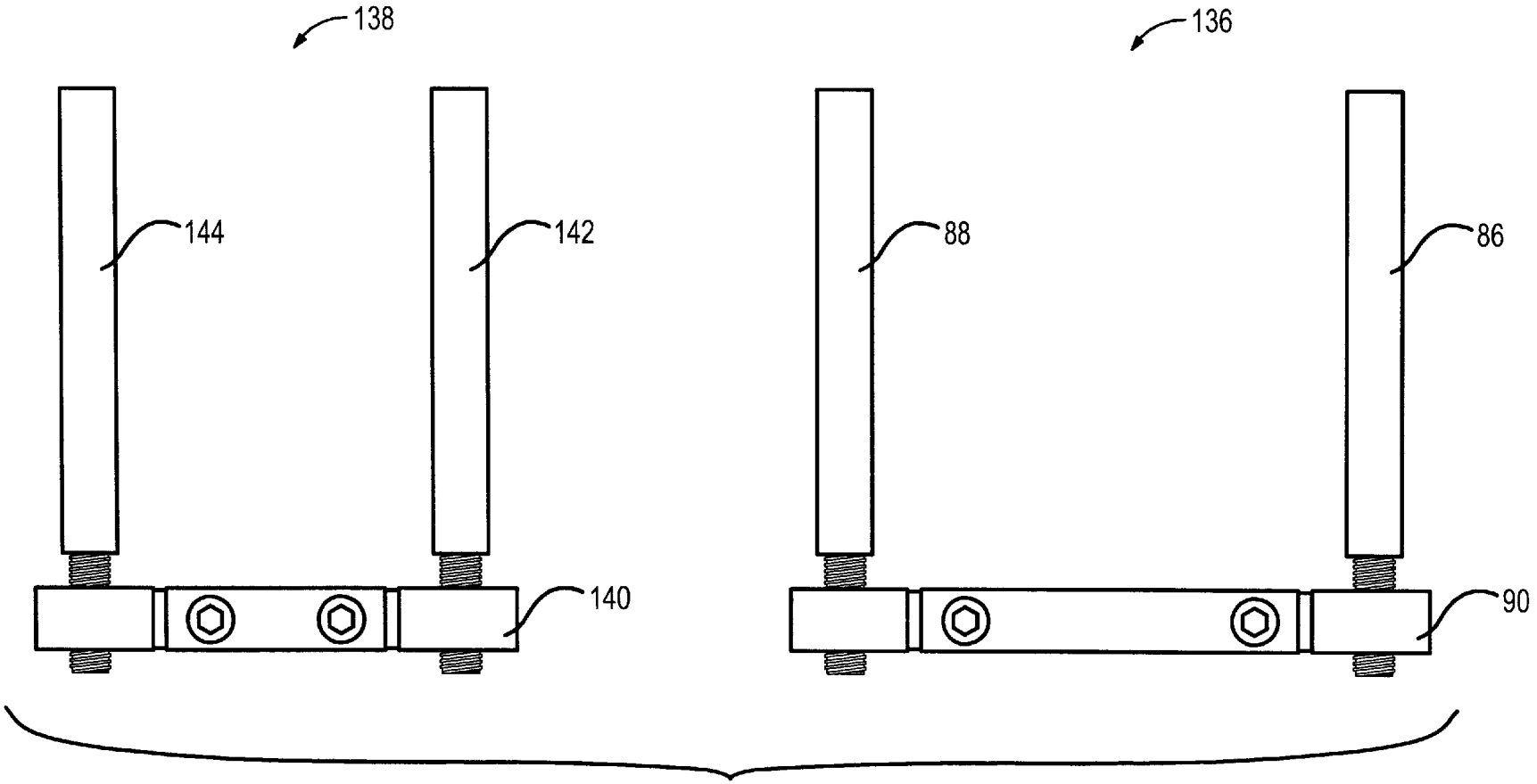
FIG. 7 shows a two-piece set of alternative forks for use in the apparatus of FIG. 1.

The balls 14–22 of FIG. 1 may be softballs having regulation 12-inch circumferences. In order to change the apparatus 10 for use with a different-sized ball, the fork assembly may be changed and the length of the connector rod 104 may be adjusted. In the preferred embodiment, the apparatus includes a set of alternative fork assemblies. Referring to FIG. 7, a two-piece set of fork assemblies 136 and 138 is shown. The fork assembly 136 may be the original assembly for use with the 12-inch softballs, while the smaller fork assembly 138 may be dimensioned for use with regulation hard balls or with tennis balls. In the same manner as the original fork assembly, the smaller fork assembly 138 includes a fork plate 140 and a pair of cantilevered prongs 142 and 144. Regarding the adjustment to the length of the connector rod of FIG. 1, the shortening of the connector rod will vary the distance of angular displacement.

The invention is best suited for periodically projecting a spherical ball, such as a tennis ball, baseball or softball. However, because the projecting belt 60 conforms to the dimensions of the ball, the invention may be used to toss American footballs, if the ball-supply path is configured to maintain the necessary rolling orientation of the footballs past the appropriate fork assembly. Moreover, the ball singulation process may be used in other applications.

What is claimed is:

1. A ball projecting apparatus which is adaptable with respect to handling different types of balls comprising:

a ramp that defines a ball-supply path;

a singulator positioned along said ramp to selectively separate a foremost bait from remaining balls along said ball-supply path, said singulator including an adjustable fork-and-actuator mechanism in which positions of fork prongs relative to each other and to said ramp determine dimensions of balls for which said singulator is suited, said fork-and-actuator mechanism having a first mode for handling a first-sized ball and having a second mode for a handling a second-sized ball that is smaller than said first-sized ball; and a projection mechanism cooperative with said ramp and said singulator to receive and project said foremost ball;

wherein said fork prongs are a pair of rods that extend in a direction generally perpendicular to travel of said foremost ball along said ball-supply path, said fork prongs being on opposite sides of a pivot point about which said fork prongs rotate.

2. The apparatus of claim 1 wherein said adjustable fork-and-actuator mechanism includes a pivotally mounted plate from which said fork prongs extend, said plate being rotatable about said pivot point.

3. The apparatus of claim 2 wherein said plate rocks between a first position in which a forward fork prong is in blocking engagement with said foremost ball and a second position in which a rearward fork prong is in blocking engagement with a next foremost ball along said ball-supply path.

4. A ball projecting apparatus comprising:

a housing having a gravity-feed ball path;

a plurality of rockers having first and second rods which extend in parallel fashion, said rockers having different spacings between said first and second rods, each of said rockers being configured to be pivotally mounted relative to said ball path such that said first and second rods of said rocker are suspended within said ball path to impede movement of a first ball when said rocker is in a first position and to release said first ball and impede an adjacent ball when said rocker is in a second position, said rocker that is pivotally mounted being selected on a basis of dimensions of said first ball and said adjacent ball;

an actuator assembly configured to manipulate said rocker that is pivotally mounted such that said rocker periodically shifts between said first and second positions; and a ball-projection chamber positioned to receive balls released from said ball path when said rocker shifts to said second position.

5. The apparatus of claim 4 wherein said first and second rods of each said rocker are cantilevered from a plate.

6. The apparatus of claim 4 wherein said actuator is adjustable with respect to varying distances of angular displacements for said rockers when shifted between said first and second positions, wherein a specific distance is selected on the basis of which of said rockers is pivotally mounted.

7. The apparatus claim 6 wherein said actuator has an adjustable-length arm, having an end configured to be connected to said rocker that is pivotally mounted.

8. The apparatus of claim 4 further comprising a firing assembly positioned to project balls from said ball-projection chamber.

9. The apparatus of claim 8 wherein said ball path is a ramp and wherein said firing assembly includes a belt that is selectively relaxed and tensioned to project said balls from said ball-projection chamber.

10. The apparatus of claim 4 wherein said rockers include a baseball rocker having said first and second rods spaced apart by a distance selected to manipulate baseballs along said ball path and further include a softball rocker having first and second rods spaced apart by a distance selected to manipulate softballs along said ball path.

11. The apparatus of claim 4 wherein said rockers are independently toned metallic devices that include a rocker plate and cylindrical cantilevered members, said cylindrical cantilevered members being said first and second rods.

12. A ball projecting apparatus which is adaptable with respect to handling different types of balls comprising:

a ramp that defines a ball-supply path;

a singulator positioned along said ramp to selectively separate a foremost ball from remaining balls along said ball-supply path, said singulator including an adjustable fork-and-actuator mechanism in which positions of fork prongs relative to each other and to said ramp determine dimensions of balls for which said singulator is suited, said fork-and-actuator mechanism having a first mode for handling a first-sized ball and having a second mode for a handling a second-sized ball that is smaller than said first-sized ball; and a projection mechanism cooperative with said ramp and said singulator to receive and project said foremost ball;

wherein said fork-and-actuator mechanism includes a plurality of alternative forks, each said fork having forward and rearward fork prongs, wherein different said forks have different separations between said forward and rearward fork prongs, said separations being selected to accommodate manipulation of sports balls having specific dimensions.

13. The apparatus of claim 12 wherein said forks include a first fork that is seated within said singulator when said fork-and-actuator mechanism is in said first mode and include a second fork that is seated within said singulator when said fork-and-actuator mechanism is in said second mode.

14. The apparatus of claim 13 wherein said fork-and-actuator mechanism includes an adjustable length actuator arm connected to manipulate movement of the specific said fork seated within said singulator, wherein an adjusted length of said actuator arm determines a spatial relationship between said fork prongs and said ramp.

15. A ball projecting apparatus which is adaptable with respect to handling different types of balls comprising:

a ramp that defines a ball-supply path;

a singulator positioned along said ramp to selectively separate a foremost ball from remaining balls along said ball-supply path, said singulator including an adjustable fork-and-actuator mechanism in which positions of fork prongs relative to each other and to said ramp determine dimensions of balls for which said singulator is suited, said fork-and-actuator mechanism having a first mode for handling a first-sized ball and having a second mode for a handling a second-sized ball that is smaller than said first-sized ball; and a projection mechanism cooperative with said ramp and said singulator to receive and project said foremost ball;

wherein operations by said adjustable fork-and-actuator mechanism are controlled by linked members projecting from a rotating is continuous chain.

16. The apparatus of operations of claim 15 wherein operations of said projection mechanism are controlled by said linked members of said continuous chain.

* * * * *